US006309696B1

(12) United States Patent
Mochizuki et al.

(10) Patent No.: US 6,309,696 B1
(45) Date of Patent: Oct. 30, 2001

(54) SUBLIMATION THERMAL TRANSFER IMAGE RECORDING MATERIAL

(75) Inventors: Hidehiro Mochizuki; Shinya Kawahara; Makoto Sekiyama, all of Numazu; Yutaka Ariga, Fujinomiya, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/416,020

(22) Filed: Oct. 8, 1999

Related U.S. Application Data

(62) Division of application No. 08/991,594, filed on Dec. 15, 1997, now Pat. No. 6,046,132.

(30) Foreign Application Priority Data

Feb. 13, 1997 (JP) ..... 9-044793

(51) Int. Cl.[7] ..... B41M 5/035; B41M 5/38
(52) U.S. Cl. ..... 427/152; 503/227
(58) Field of Search ..... 8/471; 428/195, 428/913, 914; 503/227; 427/152

(56) References Cited

U.S. PATENT DOCUMENTS 4,873,220 * 10/1989 Kubodera et al. .
5,071,824 * 12/1991 Ohara et al. .

* cited by examiner

*Primary Examiner*—Bruce H. Hess
(74) *Attorney, Agent, or Firm*—Cooper & Dunham LLP

(57) ABSTRACT

A sublimation thermal transfer recording material which includes a substrate and an ink layer formed on the substrate for forming a color image, the ink layer including a plurality of sublimable dye groups each of which has different hue and each of which includes one or more sublimable dyes, wherein, provided that weighted average values of solubility of each dye to toluene in each sublimable dye group are values D1, D2, D3, . . . , and Dn, and a maximum value thereof is Dh, each of the values Dn other than the maximum value Dh is greater than about 0.5×Dh, and/or wherein, provided that weighted average values of a product of solubility of each dye to toluene and an extinction coefficient of the dye in each sublimable dye group are values E1, E2, E3, . . . , and En, and a maximum value thereof is Eh, each of the values En other than the maximum value Eh is greater than about 0.5×Eh.

6 Claims, No Drawings

SUBLIMATION THERMAL TRANSFER IMAGE RECORDING MATERIAL

CROSS REFERENCE TO RELATED APPLICATION

This application is a division of applicants' U.S. patent application Ser. No. 08/991,594, filed Dec. 15, 1997, now U.S. Pat. No. 6,046,132.

BACKGROUND OF THE INVENTION

1. Field of the Invention

The present invention relates to a sublimation thermal transfer image recording material, and more particularly, to a sublimation thermal transfer image recording material having good half tone image reproduction ability in which a recorded color image has uniform hue regardless of its image density, as well as to an image recording material useful for multiple sublimation thermal transfer recording which can maintain good image qualities such as high image density and the good half tone images without difference of hue when the image recording material is repeatedly used multiple times of use for n-fold speed mode multiple sublimation thermal transfer recording material.

2. Discussion of the Related Art

Recently, the demand for full color recording has increased year by year. There have been known various full color recording methods including electrophotographic recording methods, ink jet recording methods and thermal transfer recording methods. Among these methods, thermal transfer recording methods are widely employed because of having the following advantages over the other recording methods:

(1) a full color image having good image qualities can be recorded relatively speedily without generating noise; and (2) operation and maintenance of the recording apparatus are relatively easy.

The thermal transfer recording methods are broadly classified into a thermofusing thermal transfer recording method which transfers thermofusible ink onto a receiving material to form an image thereon and a sublimation thermal transfer recording method which transfers a thermo-diffusional dye (hereinafter referred to as a sublimable dye) onto a receiving material to form an image thereon. The sublimation thermal transfer recording method is superior to the thermofusing thermal transfer recording method because of having excellent half tone images caused by the transfer of a molecule of the thermo-diffusional dye. Therefore the sublimation thermal transfer recording method is a suitable method for full color recording.

In sublimation thermal transfer recording, a sublimation dye image can be obtained on a sublimation thermal transfer image receiving material (referred to as a receiving material) upon application of heat with a thermal printhead, laser or the like to the back side of a sublimation thermal transfer image recording material (referred to as a recording material) having an ink layer which contacts the receiving material and which includes a sublimable dye. The recording material includes a substrate and an ink layer which is formed on the substrate and includes a sublimable dye dispersed in a binder resin. A full color image can typically be obtained by appropriately transferring a yellow color dye, a magenta color dye, a cyan color dye and, if necessary, a black color dye onto a receiving material. The recording material may include a heat resistant layer on the back side thereof to make the recording material resistant to heat applied with thermal printheads. The receiving material includes a substrate and optionally an image receiving layer (referred to as a receiving layer) which is formed on the substrate. When heat is applied to the recording material, the sublimable dye diffuses into the receiving material or the receiving layer of the receiving material, so that an image is formed on the receiving material.

Sublimable dyes for use in the recording material have to have good diffusing ability under a heating condition in which a thermal printhead at high temperature (hundreds of degrees centigrade) contacts the recording material for a moment (several milliseconds) and have to have good color tone and good light resistance, to form an image having good image qualities such as high image density, good color tone reproducibility and good light resistance of the recorded image. In addition, the sublimable dyes have to be safe. There are few sublimable dyes having all of these properties. Therefore, a plurality of yellow dyes, magenta dyes, cyan dyes and if necessary, black dyes are indeed used for forming a full color image, although it is preferable that a full color image can simply be formed with one kind each of a yellow dye, a magenta dye and a cyan dye. For example, a magenta color recording material generally includes a red dye and a violet dye, a cyan color recording material includes a blue dye and a green dye and a black color recording material includes yellow, magenta and cyan dyes.

Recording materials are typically manufactured with a gravure coating method. When an image is recorded using a recording material which has a one layer type ink layer coated by a gravure coating method, the image tends to be uneven because the coated ink layer has unevenness corresponding to the form of cups of the gravure plate. Therefore, an ink layer is generally formed by coating twice a recording layer coating liquid including a resin and a sublimable dye which are dissolved or dispersed in a solvent (Japanese Laid-Open Patent Publication No. 63-302089) to form an even ink layer. Even in this case, when half tone images are recorded using a recording material having a recording layer including two or more sublimable dyes having different hues, the recorded half tone image tends to have different color tone depending on its image density. For example, when half tone images are recorded using a magenta colored recording material including a red sublimable dye and a violet sublimable dye, the recorded half tone image having relatively low image density has relatively violet-like (or reddish) magenta color compared to the half tone image having relatively high image density.

In addition, the sublimation thermal transfer recording method costs more than other methods, because:

(1) a sublimable dye is relatively expensive;

(2) yellow, magenta, cyan and if necessary, black color recording materials, each individually being of equal size to the recorded image, are needed to obtain a full color image; and (3) used recording materials must be disposed of even though there may be large unused portions of the recording material.

To obviate these shortcomings, so-called multiple sublimation thermal transfer recording methods and recording materials therefor have been proposed. The multiple sublimation thermal transfer recording methods include an n-time (n is at least 2) mode multiple sublimation thermal transfer recording method and an n-fold (n is more than 1 and generally 5 to 20) speed mode multiple sublimation thermal transfer recording method. A recording material for the multiple sublimation thermal transfer recording methods is disclosed which can produce images having good image qualities such as high image density even in a large-n-time or a large n-fold multiple sublimation thermal transfer recording method. The recording material has two or more overlaid ink layers which are, for example, a dye-supplying layer which is formed on a substrate and which includes a sublimable dye dispersed in a resin, and a dye-transferring layer formed on the dye-supplying layer, wherein the dye releasing ability of the dye-supplying layer is larger than that of the dye-transferring layer.

In multiple sublimation thermal transfer recording, when a recording material including an overlaid ink layer in which at least the bottom ink layer includes two or more sublimable dyes is used, problems occur in which a color tone of the initially recorded image is different from that of the recorded image after the recording material is used n-times in the n-time multiple sublimation thermal recording or a color tone in a relatively light half tone image is different from that of a relatively dark half tone image.

Because of these reasons, a need exists for a sublimation thermal transfer recording material which can produce images having good image qualities, particularly produce half tone images having good evenness in color tone by a one-time or a multiple sublimation thermal transfer recording method.

SUMMARY OF THE INVENTION

Accordingly, one object of the present invention is to provide a sublimation thermal transfer recording material which can produce images having good image qualities, particularly produce half tone images having good evenness in color tone by a one-time or a multiple sublimation thermal transfer recording method.

To achieve such an object, the present invention contemplates the provision of a sublimation thermal transfer recording material which includes an ink layer formed overlying a substrate to produce a color image and in which the ink layer includes a plurality of sublimable dye groups each of which has a different hue and each of which includes one or more sublimable dyes, wherein, provided that the weighted average values of solubility of the sublimable dye to toluene in each sublimable dye group are respectively values D1, D2, D3 . . . Dn, and the maximum value thereof is Dh, each of the values Dn other than the maximum value is greater than about 0.5×Dh, and preferably greater than about 0.7×Dh.

In another embodiment of the present invention, a sublimation thermal transfer recording material is provided which includes an ink layer formed overlying a substrate to produce a color image and in which the ink layer includes a plurality of sublimable dye groups each of which has a different hue and each of which includes one or more sublimable dyes, wherein, provided that the weighted average values of the product of solubility of each sublimable dye to toluene and the extinction coefficient of the sublimable dye in each sublimable dye group are respectively values E1, E2, E3 . . . En, and the maximum value thereof is Eh, each of the values En other than the maximum value is greater than about 0.5×Eh, and preferably greater than about 0.65×Eh.

Preferably, the ink layer is an overlaid ink layer in which each sublimable dye group included in an ink layer is included in another ink layer and the weight ratio of each sublimable dye group in the lower ink layer is substantially the same as that of another ink layer.

These and other objects, features and advantages of the present invention will become apparent upon consideration of the following description of the preferred embodiments of the present invention.

DESCRIPTION OF THE PREFERRED EMBODIMENTS

The sublimation thermal transfer recording material (hereinafter referred to as a recording material) of the present invention includes a substrate and an ink layer which is formed overlying the substrate and in which the ink layer includes a plurality of sublimable dye groups each of which has a different hue and includes one or more sublimable dyes. The structure of the recording material is not limited thereto. For example, the recording material may include an intermediate layer which is formed between the substrate and the ink layer to securely adhere the ink layer to the substrate, a resin layer which is formed on the top of the ink layer and which includes a resin having relatively low dye receivability to avoid occurrence of a ghost image, and a heat resistant layer which is formed on the back side of the substrate to prevent the recording material from sticking to a thermal printhead which is a most popular heating device for thermal transfer recording. The ink layer preferably is an overlaid ink layer to obtain good image qualities.

As for hue of images, humans can generally discriminate difference of hue between an image (1) and another image (2) whose maximum light absorption is shifted from that of the image (1) by 20–40 nm in wavelength. In the present invention, difference of hue is defined as the difference of hue which can be discriminated by humans. Generally, hue is broadly classified into a yellow, an orange, a red, a violet, a blue and a green color. In a case of producing a black colored image, dyes having a yellow, a magenta and a cyan color are used. Yellow color dyes include lemon yellow and bright yellow color dyes, magenta color dyes include reddish magenta and violet-like magenta color dyes, and cyan dyes include greenish cyan and bluish cyan color dyes.

The recording material of the present invention can be used for one-time sublimation thermal transfer recording (referred to as one-time recording) and multiple sublimation thermal transfer recording (referred to as multiple recording) such as n-time mode multiple recording or n-fold speed mode multiple recording.

The recording material of the present invention includes one or more ink layers in which at least one ink layer includes two or more sublimable dye groups to produce a color image on a receiving material, each of the sublimable dye groups having a different hue and including one or more sublimable dyes, wherein, provided that the weighted average values of solubility of each sublimable dye to toluene in each sublimable dye group are respectively values D1, D2, D3 . . . Dn, and the maximum value thereof is Dh, the values Dn other than the maximum value are greater than about 0.5×Dh, and preferably greater than about 0.7×Dh.

Namely, provided that when the ink layer includes a sublimable dye (hereinafter referred to as a dye) la having a hue (1), dyes 2a and 2b each having a hue (2) and dyes 3a, 3b and 3c each having a hue (3), solubility of each dye to toluene is 1at, 2at, 2bt, 3at, 3bt and 3ct, respectively, and a content of each dye in the ink layer is 1aH, 2aH, 2bH, 3aH, 3bH and 3cH, respectively, values D1, D2 and D3 of each hue (1), (2) and (3) are defined as follows:

$$D1=1at\times 1aH/1aH,$$

$$D2=\{2at\times 2aH/(2aH+2bH)\}+\{2bt\times 2bH/(2aH+2bH)\},$$

and $$D3=\{3at\times 3aH/(3aH+3bH+3cH)\}+\{3bt\times 3bH/(3aH+3bH+3cH)\}+\{3ct\times 3cH/(3aH+3bH+3cH)\}.$$

If D2 is a maximum value, each of D1 and D3 is preferably greater than about 0.5×D2, and more preferably greater than about 0.7×D2.

The image density of a recorded image depends on the product of the amount of a transferred dye and the extinction coefficient thereof. Therefore,the extinction coefficient of the dye should be taken into account together with the value D.

In consideration of the extinction coefficient, provided that the weighted average values of the product of solubility of each dye to toluene and the extinction coefficient of the sublimable dye in each sublimable dye group are respectively values E1, E2, E3 . . . En, and the maximum value thereof is Eh, the values En other than the maximum value are greater than about 0.5×Eh, and preferably greater than about 0.65×Eh.

Namely, provided that the ink layer includes dyes 1a and 1b, each having a hue (1), and dyes 2a and 2b, each having a hue (2), the solubility of each dye to toluene is 1at, 1bt, 2at and 2bt, respectively, the content of each dye in the ink layer is 1aH, 1bH, 2aH and 2bH, respectively, and the extinction coefficient of each dye is 1ak, 1bk, 2ak and 2bk, respectively, values of E1 and E2 of each hue (1) and (2) are defined as follows:

$$E1=(1at\times 1ak\times\{1aH/(1aH+1bH)\})+(1bt\times 1bk\times\{1bH/(1aH+1bH)\}),$$

and $$E2=(2at\times 2ak\times\{2aH/(2aH+2bH)\})+(2bt\times 2bk\times\{2bH/(2aH+2bH)\}).$$

If E2 is a maximum value, E1 is preferably greater than about 0.5×E2, and more preferably greater than about 0.65×E2.

The solubility of a dye to toluene is determined for example, by the following method:

(1) a dye is excessively added to a predetermined quantity of toluene at room temperature;

(2) the dye solution is stirred and settled at the temperature for about 1 day to obtain a saturated toluene solution of the dye; and (3) the absorbance of the saturated solution is measured; and (4) the solubility of the dye to toluene is determined from the obtained absorbance with a relationship between the content of the dye and absorbance (i.e., an extinction coefficient) which has previously been obtained.

Suitable substrates for use in the recording material include known films of resins such as polyester resins, polysulfone resins, polystyrene resins, polycarbonate resins, cellophane, polyamide resins, polyimide resins, polyarylate resins, polyethylene naphthalate resins or the like. The thickness of the films is preferably from about 0.5 to about 20 μm, and more preferably from about 3 to about 10 μm. The substrate may include a heat resistant layer on the back side thereof, if desired.

Next, the ink layer of the recording material of the present invention is hereinafter described.

Suitable sublimable dyes for use in the ink layer include known sublimable dyes, which can sublimate or vaporize at a temperature higher than 60° C., such as disperse dyes, oil soluble dyes and the like.

Specific examples of such sublimable dyes include, but are not limited to:

C.I. Disperse Yellows 1, 3, 8, 9, 16, 41, 54, 60, 77 and 116;

C.I. Disperse Reds 1, 4, 6, 11, 15, 17, 55, 59, 60, 73 and 83;

C.I. Disperse Blues 3, 14, 19, 26, 56, 60, 64, 72, 99 and 108;

C.I. Solvent Yellows 77 and 116;

C.I. Solvent Reds 23, 25 and 27; and

C.I. Solvent Blues 36, 63, 83 and 105.

These sublimable dyes are employed alone or in combination.

Suitable binder resins for use in the ink layer of the recording material include thermoplastic resins such as polyvinyl chloride resins, polyamide resins, polycarbonate resins, polystyrene resins, acrylic resins, phenolic resins, polyester resins, epoxy resins, fluorine-containing resins, polyvinyl acetal resins, cellulose resins, copolymers thereof and the like. These resins are employed alone or in combination. Among these resins, cellulose resins and polyvinyl acetal resins are preferable because of having good solubility to organic solvents used for an ink layer coating liquid and good adhesion to the substrate of the recording material. More preferably, polyvinyl acetal resins such as polyvinyl acetoacetal and polyvinyl butyral are used as a binder resin of the ink layer.

The ink layer of the recording material of the present invention can be manufactured, for example, by one of the following methods:

(1) a plurality of dye groups having different hues are dispersed in a binder resin solution so that each of values Dn is greater than about 0.5×Dh to form an ink layer coating liquid (A), or a plurality of dye groups having different hues are dispersed in a resin solution so that each of E values is greater than about 0.5×Eh to form an ink layer coating liquid (B), and then the ink layer coating liquid (A) (or (B)) is coated on a substrate and then dried to form an ink layer. The ink layer preferably has two or more layers which are overlaid. The ink layers may be aged after being dried, if required.

(2) an ink layer coating liquid (A) (or (B)) in which dyes are dispersed in a particulate state in a binder resin so that each of values Dn (or En) is more than 0.5×Dh (or more than 0.5×Eh) is coated on a substrate and dried to form a lower ink layer (hereinafter referred to as a dye-supplying layer), and then another ink layer coating liquid (A)' (or (B)') in which at least one dye is dispersed in a molecular state is coated on the dye-supplying layer to form an upper ink layer (hereinafter referred to as a dye-transferring layer). The dye-transferring layer may include a resin layer having relatively low dye receivability. The ink layers may be aged after being dried, if required.

(3) an ink layer coating liquid (A) (or (B)) in which dyes are dispersed in a particulate state in a binder resin so that each of values Dn (or En) is more than 0.5×Dh (or more than 0.5×Eh) is coated on a substrate and dried to form a dye-supplying layer, and then a resin layer coating liquid which includes a resin having relatively low dye receivability and a solvent is coated thereon to form a resin layer having relatively low dye receivability. The ink layers may be aged after being dried.

(4) an ink layer coating liquid (A) (or (B)) in which dyes are dispersed in a particulate state in a binder resin so that each of values Dn (or En) is more than 0.5×Dh (or more than 0.5×Eh) is coated on a substrate and dried to form a dye-supplying layer, and then an ink layer coating liquid (A)' (or (B)') in which at least one dye is dispersed in a molecular state is coated on the dye-supplying layer to form a dye-transferring layer, and further a resin layer coating liquid which includes a resin having relatively low dye receivability and a solvent is coated thereon to form a resin layer having relatively low dye receivability. The ink layers may be aged after being dried.

Suitable solvents for use in the ink layer coating liquid which dissolve or disperse sublimable dyes and a binder resin include known solvents such as alcohol type solvents, e.g., methanol, ethanol, isopropyl alcohol, butanol and isobutanol; ketone type solvents such as methyl ethyl ketone, methyl isobutyl ketone and cyclohexanone; aromatic solvents such as toluene and xylene; halogen-containing solvents such as dichloromethane and trichloroethane; dioxane; tetrahydrofuran; formamide; dimethylformamide; dimethylsulfoxide. These solvents are employed alone or in combination. The solvents for use in the ink layer coating liquid are generally selected so as to dissolve the sublimable dyes in a high solid content and the binder resin in a high solid content. Toluene and methyl ethyl ketone are preferable because of having good evaporation speed, good ability to dissolve binder resins and sublimable dyes, and being relatively inexpensive.

A suitable solvent useful for measuring solubility of a dye is toluene because toluene, which is one of the aromatic solvents, can easily dissolve disperse dyes and oil soluble dyes which have an aromatic group.

A method for preparing an ink layer coating liquid (A) is, for example, as follows:

(1) selecting dyes which have different hues and which can produce a color image such as one of the three primary colors (i.e., yellow, magenta and cyan color) or one of special colors (e.g., flesh color or the like) so that the resultant recording material has good dye transferability and a recorded image has good image density, good reproducibility of the color, and light resistance; and (2) determining a content of each dye so that each of values Dn is greater than about 0.5×Dh, and if there is a value Dn which is less than 0.5×Dh, a dye which has relatively large solubility to toluene and which has the same hue as the dye groups whose value Dn is less than 0. 5×Dh is added to increase the value Dn to be greater than 0.5×Dh.

In order to increase a value Dn to be greater than 0.5×Dh, another method can be used in which a dye which has relatively small solubility to toluene and which has the same hue as the dye group whose value Dn is Dh is added to the ink layer coating liquid to decrease the value Dh. In this case, if another value Dn' becomes a maximum value Dh, the changed value Dn should be compared with the new Dh, i.e., Dn'. This method is particularly useful for a case in which there are a plurality of values Dn which are less than 0.5×Dh. The dye to be added to the ink layer coating liquid to increase the value Dn preferably has solubility greater than Dh, and the dye to be added to decrease the value Dh preferably has solubility less than 0.5×Dh.

The ink layer coating liquid (B) can be similarly prepared by a method in which the value D is replaced with the value E in the above-mentioned method for preparing the ink layer coating liquid (A). If there is a value E which is less than 0.5×Eh, a dye which has a relatively large solubility to toluene and/or a relatively large extinction coefficient and which has the same hue as the dye groups whose value En is less than 0.5×Eh, or a dye which has a relatively small solubility to toluene and/or a relatively small extinction coefficient and which has the same hue as a dye group whose value En is Eh, is added to the ink layer coating liquid. The dye to be added to the ink layer coating liquid to increase the value En preferably has a value of a product of solubility to toluene and its extinction coefficient greater than Eh, and the dye to be added to decrease the value Eh preferably has a value of a product of solubility to toluene and its extinction coefficient less than 0.5×Eh.

By adding a dye having a relatively large or small solubility and/or a relatively large or small extinction coefficient to adjust the values Dn or Dh or the values En or Eh, the addition quantity can be as small as possible, resulting in maintenance of good recordability of the recording material and good image qualities.

The ink layer of the recording material of the present invention is preferably an overlaid ink layer in which each of sublimable dye groups having different hues and included in a lower layer (dye-supplying layer) are also included in an upper layer (dye-transferring layer) so that the ratio of the contents of each dye group in the dye-transferring layer is substantially the same as that of the dye-supplying ink layer.

If a dye transferring layer which includes a magenta dye group including a red dye and a violet dye is formed on a dye supplying layer which also includes the magenta dye group including the red dye and the violet dye in which the ratio of the red dye to the violet dye in the dye transferring layer is larger than that of the dye supplying layer, a recorded half tone image having a relatively low or medium image density is relatively reddish compared to a recorded image having a relatively high image density.

In order to prepare a good dye-transferring ink layer, for example, the following coating methods can be used.

(1) a dye-transferring coating liquid which includes a resin, the same dye groups as used in the dye-supplying layer, the ratio of the content of each dye group being almost equal to that of the dye-supplying layer, and a solvent to which the dyes included in the dye-supplying layer have almost equal solubility, is coated on the dye-supplying layer to maintain the ratio of the content of each dye group in the dye-transferring layer to be substantially the same as that of the dye-supplying layer even when the dyes in the dye supplying layer are migrated to the dye transferring layer when the dye transferring layer coating liquid is coated.

(2) a dye-transferring coating liquid which includes a resin, the same dye groups as used in the dye-supplying layer, the ratio of the content of each dye group being substantially the same as that of the dye-supplying layer, and a solvent to which the dyes included in the dye-supplying layer have relatively small solubility (less than about 20 g/l), is coated on the dye-supplying layer to prevent the dyes in the dye-supplying layer from migrating to the dye-transferring layer or to minimize the migration, resulting in maintenance of the ratio of the content of each dye group in the dye-supplying layer and the dye-transferring layer.

In this case, suitable solvents for use in the dye-transferring layer coating liquid include known solvents to which the dyes included in the dye-supplying layer have relatively small solubility. Specific examples of such solvents include:

alcohol solvents such as methyl alcohol, ethyl alcohol, allyl alcohol, propyl alcohol, butyl alcohol, amyl alcohol, 3-methoxybutyl alcohol, hexyl alcohol, 2-methyl pentanol, sec-hexyl alcohol, 2-ethyl butyl alcohol, heptyl alcohol, sec-heptyl alcohol, octyl alcohol, 2-ethylhexyl alcohol, sec-octyl alcohol, nonyl alcohol, 2,6-dimethyl-4-heptanol, trimethylnonyl alcohol and the like; and glycol ether solvents having a hydroxy group such as ethylene glycol monomethyl ether, ethylene glycol monoethyl ether, ethylene glycol monoisopropyl ether, ethylene glycol monobutyl ether, ethylene glycol monoisoamyl ether, ethylene glycol monohexyl ether, ethylene glycol mono-2-ethylbutyl ether, diethylene glycol monomethyl ether, diethylene glycol monoethyl ether, propylene glycol monoethyl ether and the like.

These solvents are employed alone or in combination. (3) when a dye-transferring layer coating liquid which includes a resin, the same dye groups as used in the dye-supplying layer, and a solvent to which the dyes included in the dye-supplying layer have different solubility, is coated on the dye-supplying layer, a dye which is included in the dye supplying layer and whose solubility to the solvent included in the dye-transferring layer coating liquid is relatively small compared to the other dyes included in the dye supplying layer should be contained in the dye-transferring layer coating liquid in an amount of content greater than the other dyes to maintain the ratio of the content of each dye group in the dye-transferring layer to be substantially the same as that of the dye-supplying layer in consideration that the extent to which the dyes in the dye-supplying layer are migrated to the dye-transferring layer corresponds to their solubility in the dye-transferring layer solvent.

(4) when a dye-transferring layer coating liquid including a solvent to which the dyes included in the dye-supplying layer have different solubility, is coated on the dye-supplying layer, another method which can be used to make the ratio of the content of each dye group substantially the same as that of the dye-supplying layer is to add, in the dye-transferring layer coating liquid, an additional dye whose solubility to the solvent included in the dye-transferring layer coating liquid is relatively large compared to the other dyes included in the dye-supplying layer and whose hue is the same as the dye group which has a relatively small solubility to the solvent of the dye-transferring layer coating liquid.

In the above-mentioned coating methods (1) and (2), the dye-transferring layer coating liquid may include no dye. In this case, the ratio of the content of the dye groups of the dye-transferring layer may be substantially the same as that of the dye supplying layer because the dyes of the dye groups are almost equally migrated or are not migrated from the dye-supplying layer when the dye-transferring layer coating liquid is coated on the dye-supplying layer.

The lower ink layer (the dye-supplying layer) of the recording material of the present invention preferably has a higher total content of dyes and/or a higher dye diffusion coefficient than the upper ink layer (the dye-transferring layer).

Concretely, in a recording material having a plurality of ink layers for one-time recording, the lower an ink layer is located, the higher dye content and/or the larger dye diffusion coefficient the ink layer preferably has. In a recording material having a plurality of ink layers for multiple recording such as:

(1) a recording material in which a dye-transferring layer including at least one dye or a resin layer including a resin having a low dye receivability and at least one dye is formed on a dye-supplying layer which includes dyes and is formed on a substrate;

(2) a recording material in which a dye-transferring layer including no dye or a resin layer including a resin having a low dye receivability and no dye is formed on a dye-supplying layer which includes dyes and is formed on a substrate; or (3) a recording material in which a dye-transferring layer including at least one dye is formed on a dye-supplying layer which includes dyes and which is formed on a substrate and further thereon a resin layer including a resin having a relatively low dye receivability and no dye is formed, the lower an ink layer is located, the higher dye content and/or the larger dye diffusion coefficient the ink layer preferably has.

When a recording material for one-time recording has one of these structures, the recording material has high thermosensitivity, the recorded images have good evenness in hue regardless of image density, and good preservability. When a recording material for multiple recording has one of these structures, the recording material can maintain good image density even when images are repeatedly recorded using a recording material, and in addition, maintain good evenness in hue regardless of the image density, the number of recording times in n-time mode multiple recording and the number of a value "n" of n-fold speed mode multiple recording.

One-time recording means that an image is formed on a receiving material by imagewise heating the back side of a recording material whose ink layer contacts the receiving material while the recording material is fed at the same speed as that of the receiving material. The used recording material is disposed of after the recording material is used only once.

Multiple recording includes:

(1) an n-time mode multiple recording method in which an image is formed on a receiving material using the above-mentioned one-time recording method but the recording material is repeatedly used n-times; and (2) an n-fold speed mode multiple recording method in which an image is formed on a receiving material while the recording material is fed at a speed of 1/n that of the receiving material.

The image recorded by the n-fold speed mode multiple recording method is superior to the image recorded by the n-time mode multiple recording method because of advantages such as satisfactory evenness of the recorded image and no wrinkling the recording material during the image recording process.

The content of the dyes in the upper ink layer is generally less than about 80%, and preferably from 0 to about 60% by weight. The dye is preferably dispersed in a molecular state in the upper ink layer to maintain good evenness of the recorded images and high thermosensitivity.

The thickness of the upper ink layer is from about 0.05 to about 5 $\mu$m, and preferably from about 0.1 to about 2 $\mu$m.

The content of the dye in the lower ink layer, which depends on whether the recording material is applied for one-time recording or multiple recording, is generally less than about 80%, and preferably less than about 70% by weight in the lower ink layer of the recording material for one-time recording. In the recording material for one-time recording, a dye content ratio, Q, of the dye content in the lower ink layer to the dye content in the upper ink layer is greater than 1 and not greater than 5, and preferably greater than 1 and not greater than 3. The dye is preferably dispersed in a molecular state in the lower ink layer of the recording material for one-time recording to maintain good evenness of the recorded images and high thermosensitivity. The thickness of the lower ink layer of the recording material for one-time recording is generally from about 0.05 to about 5 $\mu$m, and preferably from about 0.1 to about 2 $\mu$m.

In the recording material for multiple recording, the dye content in the lower ink layer is generally less than about 90%, preferably less than about 86%, and more preferably from about 5% to about 60% by weight. The dye content ratio, Q, is generally greater than 1.1 and not greater than 10, preferably greater than 1.1 and not greater than 5, and more preferably greater than 1.5 and not greater than 3 to maintain good image qualities in large-n-fold speed mode multiple recording or in large-n-time mode multiple recording. The dye is preferably dispersed in the lower ink layer in a state, in which particulate dyes are dispersed or both of molecular dyes and particulate dyes are included, to keep the hue of the recorded images constant and to maintain good image qualities without unevenness even in large-n-fold speed mode multiple recording or in large-n-time mode multiple recording. The thickness of the lower ink layer of the recording material for multiple recording is generally from about 0.1 to about 20 μm, and preferably from about 0.5 to about 10 μm.

In order to obtain a large diffusion coefficient in the lower ink layer, a resin or a wax having a relatively low softening point or a relatively low glass transition temperature is preferably included in the lower ink layer in an amount of from about 1 to about 90% by weight of the binder resin in the lower ink layer.

The particulate dyes included in the ink layer of the recording material of the present invention are, for example, precipitated dye particles. The term precipitated particles means dye particles which are precipitated during a drying step out of a coated ink layer coating liquid including a binder resin, dyes and a solvent. Therefore, the amount and the particle size of the precipitated dye particles change mainly depending on the solvent used. Presence of the dye particles in an ink layer can be easily observed by an electron microscope. The particle size of the dye particles which depends on the thickness of the ink layer is about 0.01 to about 20 μm, and preferably from about 1 to about 5 μm for the dye supplying layer for multiple recording. When the dyes in the ink layer are particulate, such a problem as crystallization of the dyes does not occur during preservation of the recording material.

To form an ink layer including dye particles, a solvent which dissolves the sublimable dye particles as little as possible is preferably included in the ink layer coating liquid. Specific examples of such a solvent include alcohol type solvents and solvents including a hydroxide group such as glycol ethers which are described above.

In addition, the ink layer preferably includes an upper layer, i.e., a dye-transferring layer, which is disclosed in Japanese Laid-Open Patent Publication No. 5-64980.

The dye transferability of the dye supplying layer is preferably greater than that of the dye transferring layer. Comparison of dye transferability is carried out by the following methods:

(1) both of a dye-supplying layer coating liquid and a dye-transferring layer coating liquid are coated on a respective substrate made of the same material and dried to form two sheets of single-ink-layer type recording materials so that each coating weight of the coated layers is substantially the same;

(2) each of the prepared recording materials is superimposed on a respective sheet of the same receiving material so that the coated surface of each recording material contacts the receiving layer of the receiving material, and heat is applied from the back side of each recording material, namely, heat is applied from the side of the substrate opposed to the ink layer, to record an image on the receiving layer; and (3) image density of each recorded image is measured. The recording material having the higher image density has higher dye transferability.

According to our investigation, the quantity of a diffused dye in an ink layer can be represented by the following Fick's law:

$$dn=-D\cdot(dc/dx)\cdot q\cdot dt$$

wherein dn represents a quantity of a diffused dye for a time of dt, q represents a cross section into which the dye diffuses, (dc/dx) represents a gradient of the diffused dye concentration, and D represents an average diffusion coefficient in the ink layer when heat is applied.

It will be understood from the above-mentioned equation that the ways to effectively supply a dye from a dye supplying layer to a dye transferring layer are as follows:

(1) the dye concentration in the dye supplying layer is higher than that in the dye transferring layer; and/or (2) the diffusion coefficient of the dye supplying layer is greater than that of the dye transferring layer.

The way to obtain an ink layer having a large diffusion coefficient is mentioned above.

Suitable binder resins for use in the dye supplying layer include the thermoplastic resins mentioned above for use in the ink layer.

Suitable binder resins for use in the dye-transferring layer include known thermoplastic resins and thermosetting resins. Specific examples of such resins include polyvinyl chloride resins, polyvinyl acetate resins, polyamide resins, polyethylene resins, polycarbonate resins, polypropylene resins, acrylic resins, polyester resins, polyurethane resins, epoxy resins, silicone resins, fluorine-containing resins, polyvinyl acetal resins, polyvinyl alcohol resins, cellulose resins, natural rubbers, synthetic rubbers and copolymers thereof. These resins are employed alone or in combination.

In order to make the dye transferring layer strongly adhere to the dye supplying layer, the dye transferring layer preferably includes a binder resin which has good compatibility with the binder resin in the dye supplying layer. More preferably, the dye transferring layer preferably includes a binder resin which is the same type of resin as the binder resin included in the dye supplying layer.

When the binder resin in the dye transferring layer has active hydrogen, the binder resin can be crosslinked by a reaction with an isocyanate compound to make the dye transferring layer more resistant to heat, and thereby an image having good evenness can be obtained because the ink layer does not stick to the receiving material by heat of a thermal printhead.

Specific examples of such an isocyanate compound include aromatic isocyanate compounds such as tolylene diisocyanate, 4,4-diphenylmethane diisocyanate, triphenylmethane triisocyanate, adducts of tolylene diisocyanate with trimethylolpropane, and trimers of tolylene diisocyanate; aliphatic isocyanate compounds or alicyclic isocyanate compounds such as hexamethylene diisocyanate, dicyclohexylmethane diisocyanate, isophorone diisocyanate, trimethylhexamethylene diisocyanate, 1,6,11-undecane triisocyanate, lysine diisocyanate, lysine ester triisocyanate, 1,8-diisocyanate-4-isocyanate methyloctane, 1,3,6-hexamethylene triisocyanate, bicycloheptane triisocyanate; and derivatives or modified compounds of these compounds.

Specific examples of such isocyanate compounds include Takenate D-102, D-103, D-104, D-103H, D-104N, D-106N, D-110N, D-120N, D-202, D-204, D-215, D-217, D-212M6, D-165NCX, D-170N, D-181N, Staphyloid TDH103, 113 and 703 which are manufactured by Takeda Chemical Industries Inc.

An isocyanate compound and a binder resin are preferably mixed so that the molar ratio of isocyanate groups included in the isocyanate compound to active hydrogen included in the resin is from about 0.1/1 to about 10/1, and more preferably from about 0.3/1 to about 0.7/1.

In addition, the isocyanate compound preferably has a small reaction rate in the reaction with the binder resin to obtain a dye transferring layer coating liquid having a long pot life, particularly when an aliphatic isocyanate compound or an alicyclic isocyanate compound, and more particularly an aliphatic isocyanate compound having a hydrophilic group, is used for a dye transferring layer coating liquid including an alcohol solvent.

The glass transition temperature or softening point of the dye-supplying layer is preferably lower than that of the dye-transferring layer to effectively supply dyes to the dye-transferring layer. A resin whose glass transition temperature is below 0° C. or whose softening point is lower than 60° C. is preferably employed in the dye-supplying layer.

Specific examples of such resins having relatively low glass transition temperatures or softening points include known resins, natural rubbers and synthetic rubbers. Among these resins and rubbers, polyethylene oxide (e.g., Alcocks E-30, E-45, R-150, R-400 and R-1000 manufactured by Meisei Chemical Works, Ltd.) and caprolactone polyol (e.g., Praccel H-1, H-4 and H-7 manufactured by Daicel Chemical Industries, Ltd.) are preferable. It is preferable that the glass transition temperature or the softening point of the dye-supplying layer becomes lower than that of the dye-transferring layer by adding one or more of these materials to the dye-supplying layer.

The ink layer preferably includes a resin layer having relatively low dye receivability on the top of the ink layer to avoid occurrence of a ghost image which tends to occur in n-fold speed mode multiple recording, in n-time mode multiple recording or when two or more color images are recorded one by one on the same area of the receiving material to obtain a full color image by a one-time recording method. Suitable resins for use in the resin layer having relatively low dye receivability include aromatic polyester resins, styrene-butadiene copolymers, polyvinyl acetate resins and polyamide resins, and preferably include methacrylic resins or copolymers thereof, styrene-maleic acid ester copolymers, polyimide resins, silicone resins, styrene-acrylonitrile copolymers and polysulfone resins. The thickness of the resin layer having relatively low dye receivability is about equal to that of the dye-transferring layer. The resin layer having relatively low dye receivability, the dye-transferring layer and the dye-supplying layer may include known additives such as releasing agents, antioxidants or the like.

Dye receivability of a resin is measured as follows:

(1) preparing a coating liquid by mixing a resin solution having a solid content of from 5 to 20% by weight and a silicone oil which is a mixture of SF8411 and SF8427 (both of which are manufactured by Toray Silicone Industries Inc.) mixed in a ratio of 1/1 so that the ratio of the silicone oil to the solid of the resin is 0.3/1;

(2) coating the coating liquid on a sheet of synthetic paper, Yupo FPG#95 manufactured by Oji Yuka Synthetic Paper Co., Ltd., and drying the coated liquid for 1 minute at 70° C. to form a receiving layer so that the thickness of the receiving layer is 10 μm on a dry basis;

(3) aging the thus obtained receiving material at room temperature for more than 1 day;

(4) superimposing a cyan colored recording material, e.g., a cyan colored recording material used for Mitsubishi Color Video Copy Processor SCT-CP200, on the receiving layer of the receiving material and recording an image on the receiving layer by imagewise heating the back side of the recording material using a thermal printhead, e.g., KMT-85-6MPD4 (manufactured by Kyocera Corp.), having a dot density of 6 dots/mm and an average electric resistance of 542 Ω, under a condition of applied energy of 2.00 mJ/dot; and (5) measuring the image density of the recorded image with a Macbeth reflection densitometer RD-918.

A resin whose image density is lower than 1.2 is defined as a resin having relatively low dye receivability in the present invention.

The recording material may include a heat resistant layer, which is formed on the side thereof opposite to the side of the ink layer, to prevent the recording material from sticking to a thermal printhead.

Suitable recording methods using the recording material of the present invention include one-time recording methods and multiple recording methods. Among these methods, n-fold speed mode multiple recording methods are preferable because the recording methods can cost-effectively produce good images.

Up to this point, there has been described the recording method using a thermal printhead as a heating device. However, other sublimation thermal transfer recording methods using heating devices such as a heat roller, a heat plate or laser, or sublimation thermal transfer recording methods using Joule heat generated in a recording material can be used. Among these methods, an electrosensitive thermal transfer recording method which has been disclosed, for example, in U.S. Pat. No. 4,103,066 and Japanese Laid-Open Patent Publications No. 57-14060, 57-11080 and 59-9096 is well known.

The electrosensitive thermal transfer recording material useful for the electrosensitive thermal transfer recording method in the present invention is manufactured by, for example, the following methods:

(1) forming a semiconductive layer on a substrate which includes a heat resistant resin such as polyester, polycarbonate, triacetyl cellulose, nylon, polyimide and aromatic polyamide, and powder of a metal such as aluminum, copper, iron, tin, nickel, molybdenum and silver which is dispersed in the heat resistant resin, and then forming an ink layer including a sublimable dye on the semiconductive layer; or (2) forming a semiconductive layer including powder of the above-mentioned metal described in method (1) on a substrate by an evaporation or a sputtering method and then forming an ink layer including a sublimable dye on the semiconductive layer.

The thickness of the substrate is preferably from about 2 to about 15 μm in consideration of heat conductive efficiency.

When a laser is used as the heating device of the recording method, a recording material including a substrate which can absorb laser light to generate heat is employed. For example, a recording material having a substrate including carbon or having a laser light absorbing layer which is formed on at least one side of the substrate is preferably employed.

Next the receiving material which is used together with the recording material of the present invention is described hereinafter.

The receiving material of the present invention preferably includes a receiving layer on a substrate. Suitable substrates for use in the receiving material include paper, synthetic paper, art paper, coated paper, cellulose fiber paper, polyolefin films, polyethylene terephthalate films, polycarbonate films, laminated sheet thereof or the like. In addition, a white resin film in which a white pigment or a white filler is added to a resin film or a foamed resin sheet can also be employed. The thickness of the substrate is generally from 10 to 300 μm, but is not limited thereto. The substrate may be subjected to corona discharge treatment and primer coating treatment to obtain good adhesion of the substrate and the receiving layer.

The receiving layer mainly includes a resin which receives and holds dyes sublimated from the recording material when heat is applied to the recording material.

Suitable resins for use in the receiving layer include polyolefin such as polypropylene; halogenated polymers such as polyvinyl chloride and polyvinylidene chloride; vinyl polymers such as polyvinyl acetate and polyacrylates; polyester resins such as polyethylene terephthalate and polybutylene terephthalate; polystyrene resins; polyamide resins; cellulose resins; and polycarbonate resins. Among these resins, vinyl polymers, polycarbonate resins and polyester resins are preferable.

The receiving layer may include auxiliary agents, for example, releasing agents such as modified or unmodified silicone oils and fluorine-containing; pigments such as titanium oxide, zinc oxide, calcium carbonate, silica and the like; ultraviolet absorbing agents; and antioxidants.

The thickness of the receiving layer is from about 1 to about 50 μm, and preferably from about 2 to about 5 μm.

The receiving material of the present invention useful for the n-fold speed mode multiple recording should have resistance to sticking to the recording material. The receiving layer of the receiving material preferably has a degree of gelation of from about 70 to about 99%, and more preferably from about 90 to about 99%, to maintain good resistance to sticking and good thermosensitivity of the receiving material.

The degree of gelation in the present invention is measured and defined as follows:

(1) measuring the coating weight of the receiving layer when the receiving layer is formed;

(2) cutting a sheet of the receiving material 50 mm wide and 100 mm long, and measuring the weight of the sheet;

(3) dipping the sheet into 500 g of methyl ethyl ketone (or a good solvent for the binder resin in the receiving layer) for ten minutes;

(4) pulling up the sheet from the methyl ethyl ketone and measuring the weight of the sheet after drying the solvent included in the sheet; and (5) obtaining the degree of gelation by the following equation:

(degree of gelation)={1−(weight difference between the sheet before dipping and after dipping)/(coating weight of the receiving layer of 50 mm wide and 100 mm long)}×100 (%).

Suitable resins which can be used in the receiving layer of the receiving material useful for n-fold multiple recording include known resins which have active hydrogen and can react with an isocyanate compound to form a crosslinked reaction product.

Specific examples of such resins include polyamide resins, polyethylene resins, polypropylene resins, acrylic resins, polyester resins, vinyl chloride-vinyl acetate copolymers, polycarbonate resins, polyurethane resins, epoxy resins, silicone resins, melamine resins, natural rubber, synthetic rubbers, polyvinyl alcohol resins, and cellulose resins. These resins can be employed alone or in combination. In addition, copolymers of these resins can also be employed.

Among these resins, polyester resins and vinyl chloride-vinyl acetate copolymers are preferable because these resins have good dye receivability and can easily produce a crosslinked resin having a proper degree of gelation by reacting with an isocyanate compound in the presence of a catalyst. Specific examples of such polyester resins include Vylon 200, Vylon 300, Vylon 500, GV-110, GV-230, UR-1200, UR-2300, EP-1012, EP-1032, DW-250H, DX-750H and DY-150H, which are manufactured by Toyobo Co., Ltd. Specific examples of such vinyl chloride-vinyl acetate copolymers include VYHH, VYNS, VYHD, VYLF, VMCH, VMCC, VAGH and VROH, which are manufactured by Union Carbide Corp., and Denka Vinyl #1000A, 1000MT, 1000D, 1000L, 1000CK2 and 1000GKT, which are manufactured by Denki Kagaku Kogyo K.K.

Suitable isocyanate compounds for use in the receiving layer include the isocyanate compounds described above for use in the ink layer. The ratio of the isocyanate groups in the isocyanate compound to hydroxide groups in the resin included in the receiving layer is preferably from about 0.1/1 to about 1/1 by mole.

In formation of a receiving layer of the present invention, it is preferable to age the receiving layer for a long period of time at a relatively high temperature after the receiving layer is coated and dried so that the degree of gelation of the receiving layer is about 70 to about 99%. The preferred aging temperature is from about 50 to about 150° C., and more preferably from about 60 to about 100° C. to prevent the receiving material from coloring and curling.

Suitable catalysts useful for the reaction of the resin and the isocyanate compound in the receiving layer of the receiving material of the present invention include amine type catalysts such as dimethylmethanolamine, diethylcyclohexylamine, triethylamine, N,N-dimethylpiperazine and triethylenediamine; and metal-containing catalysts such as cobalt naphthenate, lead octenate, dibutyl tin dilaurate, stannous chloride, stannic chloride, tetra-n-butyl tin, tri-n-butyl tin acetate, di-n-butyl tin oxide and di-n-octyl tin oxide. Among these catalysts, tin-containing compounds are preferable for use in the receiving layer of the receiving material of the present invention. Specific examples of the tin-containing compounds are TK1L which is manufactured by Takeda Chemical Industries Inc., or Scat1, Scat1L, Scat8, Scat10, Scat71L and StannBL, which are manufactured by Sankyo Organic Synthesis Co., Ltd. To obtain-good heat resistance and good thermosensitivity, the preferred content of the catalyst in the receiving layer is from about 0.05 to about 1.3% by weight of the receiving layer.

The receiving layer of the receiving material of the present invention preferably includes at least one of an antioxidant, a photostabilizer and an ultraviolet absorbing agent to prevent the receiving layer and images formed thereon from coloring or fading. The preferred total content of an antioxidant, a photostabilizer and an ultraviolet absorbing agent is about 0.05 to about 30 parts by weight per 100 parts of total weight of resins in the receiving layer. If a protective layer, which is optionally formed on the receiving layer to obtain good light resistance of recorded images, includes an ultraviolet absorbing agent, an ultraviolet absorbing agent is not necessarily included in the receiving layer.

Specific examples of an antioxidant for use in the receiving layer of the receiving material of the present invention include an amine type antioxidant such as N, N'-diphenyl-1,4-phenylenediamine and phenyl-β-naphthylamine; a phenol type antioxidant such as 2,6-di-t-butyl-β-cresol, 4,4'-butylidene-bis(3-methyl-6-butylphenol) and tetrakis{methylene-3-(3',5'-di-t-butyl-4'-hydroxyphenyl) propionate}; a sulfur-containing antioxidant such as 2-mercaptobenzothiazole and distearylthiodipropionate; hydroquinone type antioxidant such as 2,5'-di-t-butyl-hydroquinone; and guanidine derivatives such as 1,3-dicyclohexyl-2-(2',5'-dichlorophenyl)guanidine.

Suitable photostabilizers for use in the receiving layer of the receiving material of the present invention include hindered amines and hindered phenols. Tertiary amine type photostabilizers are preferable because they do not react with an isocyanate compound to be used for the receiving layer. Specific examples of the tertiary amine type photostabilizer include Adekastab LA-82, Adekaarcles DN-44M which are manufactured by Asahi Denka Kogyo K.K. and Sanol LS-765 which is manufactured by Sankyo Co., Ltd.

Suitable ultraviolet absorbing agents for use in the receiving layer of the receiving material of the present invention include known ultraviolet absorbing agents such as hydroxybenzophenone compounds, dihydroxybenzophenone compounds, benzotriazole compounds, hindered amine compounds and salicylate derivatives. Specific examples of the ultraviolet absorbing agents include Tinuvin P (manufactured by Ciba Geigy Ltd.), 2-hydroxy-4-methoxybenzophenone, 2-hydroxy-4-octoxybenzophenone, 2-(2'-hydroxy-3',5'-di-t-butylphenyl)-5-chlorobenzotriazole, 2-(2-hydroxy-3, 5-di-t-butylphenyl)-2H-benzotriazol, 2-(2-hydroxy-3,5-di-t-butyl-5'-methylphenyl)-5-chlorobenzotriazole and 2-(2'-hydroxy-3'-t-butyl-5'-methylphenyl)-5-chlorobenzotriazole.

Having generally described this invention, a further understanding can be obtained by reference to certain specific examples which are provided herein for purposes of illustration only and are not intended to be limiting. In the descriptions in the following examples, numbers represent weight ratios in parts, unless otherwise specified.

EXAMPLES

Example 1

The following compounds were mixed to prepare a lower ink layer coating liquid. The lower ink layer coating liquid was coated with a wire bar on a non-layered (i.e., previously uncoated) surface of a polyethylene terephthalate film having a thickness of 4 μm which had on its other surface a heat resistant layer 1 μm thick including a silicone resin on one side thereof, and dried for 90 seconds at 100° C. to obtain a lower ink layer 0.5 μm thick.

| (Formulation of lower ink layer coating liquid) | |
|---|---|
| red colored sublimable dye (HM1041, manufactured by Mitsui Toatsu Chemicals Inc.) | 3.5 |
| violet colored sublimable dye (Macrolex Red Violet R, manufactured by Bayer Ltd.) | 2 |
| violet colored sublimable dye (HS0147, manufactured by Mitsui Toatsu Chemicals Ltd.) | 1.5 |
| polyvinyl butyral resin (BX-1, manufactured by Sekisui Chemical Co., Ltd.) | 5 |
| toluene | 35 |
| methyl ethyl ketone | 35 |
| dioxane | 25 |

The following compounds were mixed to prepare an upper ink layer coating liquid. The upper ink layer coating liquid was coated with a wire baron a previously formed lower ink layer, and dried for 90 seconds at 100° C. to obtain an upper ink layer 0.5 μm thick.

Thus, a magenta colored recording material of the present invention useful for one-time sublimation thermal transfer recording was obtained.

| (Formulation of upper ink layer coating liquid) | |
|---|---|
| red colored sublimable dye (HM1041, manufactured by Mitsui Toatsu Chemicals Inc.) | 2.45 |
| violet colored sublimable dye (Macrolex Red Violet R, manufactured by Bayer Ltd.) | 1.4 |
| violet colored sublimable dye (HS0147, manufactured by Mitsui Toatsu Chemicals Ltd.) | 1.05 |
| polyvinyl butyral resin (BX-1, manufactured by Sekisui Chemical Co., Ltd.) | 5 |
| toluene | 47.5 |
| methyl ethyl ketone | 47.5 |

Examples 2 and 3

The procedure for preparation of the recording material in Example 1 was repeated except that the sublimable dyes were replaced with dyes whose name and addition quantity are described in Table 1. Thus, magenta colored recording materials of the present invention useful for one-time sublimation thermal transfer recording were obtained.

Comparative Example 1

The procedure for preparation of the recording material in Example 1 was repeated except that the sublimable dyes were replaced with dyes whose name and addition quantity are described in Table 1. Thus, a magenta colored comparative recording material used for one-time sublimation thermal transfer recording was obtained.

TABLE 1

| | Hue of dye | Name of dye | A.Q. | X | Y | D | W | E |
|---|---|---|---|---|---|---|---|---|
| Example 1 | red | HM1041 | 3.5 | 97 | 97 | 97 | 8051 | 8051 |
| | violet | Macrolex Red Violet R | 2.0 | 26 | 15 | 65 | 585 | 2435 |
| | violet | HS0147 | 1.5 | 116 | 50 | | 1850 | |
| Example 2 | red | HM1041 | 3.5 | 97 | 97 | 97 | 8051 | 8051 |
| | violet | Macrolex Red Violet R | 0.1 | 26 | 1 | 114 | 29 | 4198 |
| | violet | HS0147 | 3.4 | 116 | 113 | | 4169 | |
| Example 3 | red | HM1041 | 2.0 | 97 | 49 | | 4026 | |
| | red | EX90 (Mitsui Toatsu Chemicals Inc.) | 2.0 | 11 | 6 | 55 | 193 | 4219 |
| | violet | Macrolex Red Violet R | 0.1 | 26 | 9 | | 338 | |
| | violet | HS0147 | 2.0 | 116 | 77 | 86 | 2861 | 3199 |
| Comparative Example 1 | red | HM1041 | 3.5 | 97 | 97 | 97 | 8051 | 8051 |
| | violet | Macrolex Red Violet R | 3.5 | 26 | 26 | 26 | 1014 | 1014 |

The characters represent as follows:
A.Q.: an addition quantity of a dye to the coating liquid
X: solubility of a dye to toluene (g/l)
Y: a product of X and weight fractiono of a dye in a dye group having the same hue
D: a sum of Y of each dye in a dye group
W: a product of Y of each dye and an extinction coefficient of the dye ($\times 10^3$)
E: a sum of W of each dye in a dye group ($\times 10^3$)

Example 4

An intermediate adhesive layer coating liquid was coated with a wire bar on a non-layered surface of an aromatic polyamide film 6 μm thick which had on its other surface a heat resistant layer 1 μm thick including a silicone resin, dried for 90 seconds at 100° C. and then aged for 12 hours at 60° C. to form an intermediate adhesive layer. A dye-supplying layer coating liquid was then coated with a wire bar on the intermediate adhesive layer in a thickness of 4.5 μm on a dry basis, further thereon a dye-transferring layer was coated in a thickness of 0.5 μm on a dry basis and still further thereon a resin layer having relatively low dye receivability was coated in a thickness of 0.7 μm on a dry basis. The coated layers were dried for 90 seconds at 100° C. and aged for 12 hours at 60° C. after each coating.

Thus, a black colored recording material of the present invention for n-time mode multiple recording was obtained.

| | |
|---|---|
| (Formulation of intermediate adhesive layer coating liquid) | |
| polyvinyl butyral resin (BX-1, manufactured by Sekisui Chemical Co., Ltd.) | 10 |
| isocyanate compound (Colonate L, manufactured by Nippon Polyurethane Industry Co., Ltd.) | 5 |
| toluene | 95 |
| methyl ethyl ketone | 95 |
| (Formulation of dye-supplying layer coating liquid) | |
| polyvinyl butyral resin (BX-1, manufactured by Sekisui Chemical Co., Ltd.) | 10 |
| yellow colored sublimable dye (Y-2, manufactured by Nippon Kayaku Co., Ltd.) | 10 |
| magenta colored sublimable dye (SMS8, manufactured by Nippon Kayaku Co., Ltd.) | 10 |
| cyan colored sublimable dye (CY6, manufactured by Nippon Kayaku Co., Ltd.) | 8 |
| cyan colored sublimable dye (MSCyanVPG, manufactured by Mitsui Toatsu Chemicals Inc.) | 6 |
| ethanol | 180 |
| n-butanol | 10 |
| (Formulation of dye-transferring layer coating liquid) | |
| polyvinyl butyral resin (BX-1, manufactured by Sekisui Chemical Co., Ltd.) | 10 |
| isocyanate compound (Colonate L, manufactured by Nippon Polyurethane Industry Co., Ltd.) | 5 |
| ethanol | 180 |
| n-butanol | 10 |
| (Formulation of resin layer having relatively low dye receivability) | |
| styrene-maleic acid copolymer (Suprapal AP-30, manufactured by BASF Ltd.) | 5 |
| liquid A | 20 |
| n-butanol | 20 |

The liquid A was prepared by dissolved 15 g of dimethyl methoxy silane and 9 g of methyl trimethoxy silane in a mixture of 12 g of toluene and 12 g of methyl ethyl ketone, and hydrolyzing the mixture for 3 hours after adding 13 ml of 3% sulfuric acid.

Examples 5–8

The procedure for preparation of the recording material in Example 4 was repeated except that the dyes were replaced with dyes whose name and addition quantities are described in Table 2.

Thus, recording materials having a black color (Examples 4–5), a bright yellow color (Examples 6–7) and a cyan color (Example 8) of the present invention for n-time mode multiple sublimation thermal transfer recording were obtained.

Comparative Examples 2–4

The procedure for preparation of the recording material in Example 4 was repeated except that the dyes were replaced with dyes whose name and addition quantities are described in Table 2.

Thus, comparative recording materials having a black color (Comparative Example 2), a bright yellow color (Comparative Example 3) and a cyan color (Comparative Example 4) for n-time mode multiple sublimation thermal transfer recording were obtained.

TABLE 2

| | Hue of dye | Name of dye | A.Q. | X | Y | D | W | E |
|---|---|---|---|---|---|---|---|---|
| Example 4 | yellow | Y2 | 10 | 26 | 26 | 26 | 2418 | 2418 |
| | magenta | SMS8 | 10 | 20 | 20 | 20 | 1620 | 1620 |
| | cyan | CY6 | 8 | 2 | 1 | 31 | 137 | 1270 |
| | cyan | MSCyanVPG | 6 | 70 | 30 | | 1140 | |
| Example 5 | yellow | Y2 | 10 | 26 | 26 | 26 | 2418 | 2418 |
| | magenta | SMS8 | 10 | 20 | 20 | 20 | 1620 | 1620 |
| | cyan | CY6 | 9 | 2 | 2 | 20 | 216 | 1646 |
| | cyan | Foron Brilliant BlueSR (Sandoz Ltd.) | 1 | 181 | 18 | | 1430 | |
| Comparative Example 2 | yellow | Y2 | 12 | 26 | 26 | 26 | 2418 | 2418 |
| | magenta | SMS8 | 12 | 20 | 20 | 20 | 1620 | 1620 |
| | cyan | CY6 | 10 | 2 | 2 | 2 | 240 | 240 |
| Example 6 | yellow | Y2 | 28 | 26 | 26 | 26 | 2418 | 2418 |
| | red | HM1450 (Mitsui Toatsu Chemicals Inc.) | 4 | 28 | 19 | 51 | 608 | 3264 |
| | red | HM1041 | 2 | 97 | 32 | | 2654 | |
| Example 7 | yellow | Y2 | 26 | 26 | 23 | 63 | 2096 | 8176 |
| | yellow | Macrolex Yellow 6G (Bayer Ltd.) | 4 | 300 | 40 | | 6080 | |
| | red | HM1041 | 4 | 97 | 97 | 97 | 8051 | 8051 |
| Comparative Example 3 | yellow | Y2 | 30 | 26 | 26 | 26 | 2418 | 2418 |
| | red | HM1041 | 4 | 97 | 97 | 97 | 8051 | 8051 |
| Example 8 | blue | HSB2115 (Mitsubishi Chemical Corp.) | 7 | 87 | 87 | 87 | 7134 | 7134 |
| | green | HS0144 | 17 | 41 | 26 | 66 | 2132 | 4612 |
| | green | HSB2207 (Mitsubishi Chemical Corp.) | 10 | 109 | 40 | | 2480 | |
| Comparative Example 4 | blue | HSB2115 | 7 | 87 | 87 | 87 | 7134 | 7134 |
| | green | HS0144 | 27 | 41 | 41 | 41 | 3362 | 3362 |

The character have the same meaning as in Table 1.

(Formation of Receiving Material for One-time Sublimation Thermal Transfer Recording)

The following compounds were mixed to prepare a receiving layer coating liquid and the coating liquid was coated on synthetic paper (Yupo FPG#150, manufactured by Oji Yuka Synthetic Paper Co., Ltd.) and dried to form a receiving layer 6 μm thick.

Thus, a receiving material for one-time sublimation thermal transfer recording was obtained.

| (Formulation of receiving layer coating liquid) | |
|---|---|
| vinyl chloride-vinyl acetate-vinyl alcohol copolymer (VAGH, manufactured by Union Carbide Corp.) | 15 |
| alcohol modified silicone oil (SF8427, manufactured by Toray Silicone Industries Inc.) | 1 |
| toluene | 40 |
| methyl ethyl ketone | 40 |

(Formation of Receiving Material (1) for n-fold Speed Mode Multiple Recording)

The following compounds were mixed to prepare a receiving 20 layer coating liquid (1) and the coating liquid (1) was coated on synthetic paper (Yupo FPG#150, manufactured by Oji Yuka Synthetic Paper Co., Ltd.), dried, and then subjected to heat treatment for 50 hours at 60° C. to form a receiving layer 6 $\mu$m thick.

Thus, a receiving material (1) for n-fold speed mode multiple sublimation thermal transfer recording was obtained.

| (Formulation of receiving layer coating liquid (1)) | |
|---|---|
| vinyl chloride-vinyl acetate-vinyl alcohol copolymer (VAGH, manufactured by Union Carbide Corp.) | 15 |
| adduct of isophorone diisocyanate (D-140N, manufactured by Takeda Chemical Industries Inc.) | 5 |
| catalyst including tin (TK-1L, manufactured by Takeda Chemical Industries Inc.) | 0.1 |
| unmodified silicone oil (SH200, manufactured by Toray Silicone Industries Inc., kinetic viscosity of 1000 cs) | 0.5 |
| alcohol modified silicone oil (SF8427, manufactured by Toray Silicone Industries Inc.) | 0.5 |
| toluene | 40 |
| methyl ethyl ketone | 40 |

(Recording Method)

Each recording material obtained in Examples 1–3 and Comparative Example 1 was superimposed on the receiving material for one-time sublimation thermal transfer recording so that the upper ink layer of the recording material contacted the receiving layer of the receiving material. Each recording material obtained in Examples 4–8 and Comparative Examples 2–3 was similarly superimposed on the receiving material (1) for n-fold speed mode multiple recording.

Heat was then applied with a thermal printhead from the back side of the recording material to form a set of half tone images, whose image densities were stepwise changed in 11 steps from a light image to a dark image, on the receiving layer of the receiving material. The recording conditions were as follows:

| | |
|---|---|
| dot density of thermal printhead | 12 dots/mm |
| electric power applied to thermal printhead | 0.16 W/dot (for multiple recording) 0.12 W/dot (for one-time recording) |
| feeding speed of receiving material | 8.4 mm/sec |
| feeding speed of recording material | 0.6 mm/sec (for multiple recording, n = 14) 2.8 mm/sec (for multiple recording, n = 3) 8.4 mm/sec (for one-time recording) |

-continued

The following items were evaluated for the recorded images.

(1) Difference of Hue (a)

Difference of hue between a half tone image having a relatively high image density and a half tone image having a relatively low image density in each set of half tone images which was recorded on the respective receiving material by the one-time recording method or the n-fold multiple recording (n=14) was visually observed.

(2) Difference of Hue (b)

A half tone image having a relatively low image density in a set of half tone images recorded on the receiving material (1) by the n-fold multiple recording (n=14) and that recorded on the receiving material (1) by the n-fold multiple recording (n=3) was visually observed to evaluate difference of hue between images having a low image density recorded by a small-n-fold and a large-n-fold multiple recording.

The results are shown in Table 3.

TABLE 3

| | Difference of hue (a) | Difference of hue (b) | Remarks |
|---|---|---|---|
| Example 1 | Less than Comparative Example 1. The hue of the image of relatively low image density was reddish magenta. | | The value Dviolet of the violet dye group was 0.67 Dh (Dred). The value Eviolet of the violet dye group was 0.30 Eh (Ered) |
| Example 2 | Less than Example 1. The hue of the image of low image density was scarcely perceptively more reddish than the magenta of the image of the high image density. | | Dred = 0.85 Dh (Dviolet). Eviolet = 0.52 Eh (Ered). |
| Example 3 | Difference of hue could not be observed. | | Dred = 0.64 Dh (Dviolet). Eviolet = 0.76 Eh (Ered). |
| Comparative Example 1 | The hue of the image of relatively low image density was reddish magenta. | | Dviolet = 0.27 Dh (Dred). Eviolet = 0.13 Eh (Ered). |
| Example 4 | Less than Comparative Example 2. The hue of the image of low image density was yellowish black. | Less than Comparative Example 2. The hue of the image (n = 3) was relatively yellowish black compared to that of the image (n = 14). | Dyellow = 0.84 Dh (Dcyan), and Dmagenta = 0.65 Dh (Dcyan). Emagenta = 0.67 Eh (Eyellow), and Ecyan = 0.53 Eh (Eyellow). |
| Example 5 | Difference of hue could not be observed and the half tone images had good black color. | Difference of hue could not be observed and the half tone images (n = 3, 14) were good black color. | Dmagenta = 0.77 Dh (Dyellow), and Dcyan = 0.77 Dh (Dyellow). Emagenta = 0.67 Eh (Eyellow), and Ecyan = 0.68 Eh (Eyellow). |

TABLE 3-continued

| | Difference of hue (a) | Difference of hue (b) | Remarks |
|---|---|---|---|
| Comparative Example 2 | The hue of the image of low image density was yellowish and reddish black. | The hue of the image (n = 3) was relatively yellowish and reddish black compared to that of the image (n = 14). | Dcyan = 0.08 Dh (Dyellow), and Ecyan = 0.10 Eh (Eyellow). |
| Example 6 | Difference of hue could not be observed and the half tone images were good bright yellow. | Difference of hue could not be observed and the half tone images (n= 3, 14) were good bright yellow. | Dyellow = 0.51 Dh (Dred), and Eyellow = 0.74 Eh (Ered). |
| Example 7 | Difference of hue could not be observed and the half tone images were good bright yellow. | Difference of hue could not be observed and the half tone images were good bright yellow. | Dyellow = 0.65 Dh (Dred), and Ered = 0.98 Eh (Eyellow). |
| Comparative Example 3 | The hue of the image of low image density was reddish bright yellow. | The hue of the image (n = 3) was relatively reddish bright yellow compared to that of the image (n = 14). | Dyellow = 0.27 Dh (Dred), and Eyellow = 0.30 Eh (Ered). |
| Example 8 | Difference of hue could not be observed and the half tone images were good cyan. | Difference of hue could not be observed and the half tone images were good cyan. | Dgreen = 0.76 Dh (Dblue), and Egreen = 0.65 Eh (Eblue). |
| Comparative Example 4 | The hue of the image of low image density was bluish cyan. | The hue of the image (n = 3) was relatively bluish cyan compared to that of the image (n = 14). | Dgreen = 0.47 Dh (Dblue), and Egreen = 0.47 Eh Eblue). |

The results in Table 3 clearly indicate that the recording materials of the present invention can produce images having good image qualities without difference of hue between an image having a relatively low image density and an image having a relatively high image density by a one-time recording or a multiple recording. Further, in multiple recording, the recording material of the present invention can produce images having good image qualities without difference of hue between an image recorded by a relatively small-n-fold (n=3) and an image recorded by a relatively large-n-fold (n=14).

Example 9

An intermediate adhesive layer coating liquid was coated with a wire bar on a non-layered surface of an aromatic polyamide film 6 μm thick which had on its other surface a heat resistant layer 1 μm thick including a silicone resin, and dried to form an intermediate adhesive layer having a thickness of 1.0 μm. Then a dye-supplying layer was coated with a wire bar on the intermediate adhesive layer so that the thickness was 4.0 μm on a dry basis, and further thereon a dye-transferring layer was coated in a thickness of 1.0 μm on a dry basis. The recording material was then aged for 12 hours at 60° C. to cure the coated layers.

Thus, a magenta colored recording material of the present invention was obtained.

| | |
|---|---|
| (Formulation of intermediate adhesive layer coating liquid) | |
| polyvinyl butyral resin (BX-1, manufactured by Sekisui Chemical Co., Ltd.) | 10 |
| isocyanate compound (Colonate L, manufactured by Nippon Polyurethane Industry Co., Ltd.) | 5 |
| toluene | 95 |
| methyl ethyl ketone | 95 |
| (Formulation of dye-supplying layer coating liquid) | |
| polyvinyl butyral resin (BX-1, manufactured by Sekisui Chemical Co., Ltd.) | 7 |
| polyethylene oxide (Alcocks R400, manufactured by Meisei Chemical works Ltd.) | 3 |
| isodyanate compound (Colonate L, manufactured by Nippon Polyurethane industry. Co., Ltd.) | 3 |
| sublimable dye (HSR2164, manufactured by Mitsubishi Chemical Corp., solubility to toluene was 25 g/l) | 12 |
| sublimable dye (Macrolex Red Violet R, manufactured by Bayer Ltd., solubility to toluene was 26 g/l) | 18 |
| ethanol | 170 |
| n-butanol | 20 |
| (Formulation of dye-transferring layer coating liquid) | |
| polyvinyl butyral resin (BL-S, manufactured by Sekisui Chemical Co., Ltd.) | 10 |
| isocyanate compound (Colonate L, manufactured by Nippon Polyurethane Industry Co., Ltd.) | 3 |
| toluene | 190 |

Example 10

A dye-supplying layer coating liquid was coated with a wire bar on the intermediate adhesive layer which was prepared in Example 9 and dried so that the thickness was 4.0 μm on a dry basis, further thereon a dye-transferring layer coating liquid was coated and dried in a thickness of 1.0 μm on a dry basis, and still further thereon a coating liquid for a resin layer having a relatively low dye receivability was coated and dried in a thickness of 0.7 μm on a dry basis. The recording material was then aged for 12 hours at 60° C. to cure the coated layers.

Thus, a black colored recording material of the present invention was obtained.

| | |
|---|---|
| (Formulation of dye-supplying layer coating liquid) | |
| polyvinyl butyral resin (BX-1, manufactured by Sekisui Chemical Co., Ltd.) | 7 |
| polyethylene oxide (Alcocks R400, manufactured by Meisei Chemical Works Ltd.) | 3 |
| isocyanate compound (Colonate L, manufactured by Nippon Polyurethane Industry Co.,Ltd.) | 3 |
| sublimable dye (HS0144, manufactured by Mitsui Toatsu Chemicals Inc., solubility to ethanol was 3 g/l) | 15 |
| sublimable dye (Macrolex Yellow 6G, manufactured by Bayer Ltd., solubility to ethanol was 3 g/l) | 7.5 |
| sublimable dye | 7.5 |

-continued

| | |
|---|---|
| (HM-1041, manufactured by Mitsui Toatsu Chemicals Inc., solubility to ethanol was 4 g/l) | |
| ethan6l | 170 |
| n-butanol | 20 |
| (Formulation of dye-transferring layer coating liquid) | |
| polyvinyl butyral resin | 10 |
| (BX-1, manufactured by Sekisui Chemical Co., Ltd.) | |
| isocyanate compound | 3 |
| (Colonate L, manufactured by Nippon Polyurethane Industry Co., Ltd.) | |
| sublimable dye | 2 |
| (HS0144) | |
| sublimable dye | 1 |
| (Macrolex Yellow 6G) | |
| sublimable dye | 1 |
| (HM-1041) | |
| ethanol | 190 |
| (Formulation of coating liquid for resin layer having relatively low dye receivability) | |
| styrene-maleic acid copolymer | 5 |
| (Suprapal AP30, manufactured by BASF Ltd.) | |
| liquid α | 6 |
| ethanol | 20 |

Liquid α was prepared by the following method:

(1) dissolving 24 g of diphenyl methoxy silane and 9 g of vinyl triethoxy silane in a mixture of 50 g of toluene and 50 g of methyl ethyl ketone;

(2) adding 10 ml of 1% sulfuric acid to the mixture and hydrolyzing the mixture for 3 hours;

(3) adding 150 ml of water and 50 ml of toluene to the mixture and stirring for 1 hour;

(4) separating the toluene phase from the water phase and eliminating water from the toluene phase for 1 day after adding anhydrous sodium sulfate;

(5) evaporating toluene to obtain an oily hydrolysis product; and (6) adding dioxane to the hydrolysis product to prepare a 50% dioxane solution of the product, i.e., a liquid α.

Example 11

A dye-supplying layer coating liquid was coated with a wire bar on the intermediate adhesive layer which was prepared in Example 9 and dried so that the thickness was 4.0 μm on a dry basis, further thereon a dye-transferring layer coating liquid was coated and dried in a thickness of 1.0 μm on a dry basis, and still further thereon a coating liquid for a resin layer having a relatively low dye receivability was coated and dried in a thickness of 0.7 μm on a dry basis. The recording material was then aged for 12 hours at 60° C. to cure the coated layers.

Thus, a black colored recording material of the present invention was obtained.

| | |
|---|---|
| (Formulation of dye-supplying layer coating liquid) | |
| polyvinyl butyral resin | 7 |
| (BX-1, manufactured by Sekisui Chemical Co., Ltd.) | |
| polyethylene oxide | 3 |
| (Alcocks R400, manufactured by Meisei Chemical Works Ltd.) | |
| isocyanate compound | 3 |
| (Colonate L, manufactured by Nippon Polyurethane Industry Co., Ltd.) | |
| sublimable dye | 15 |
| (HSO144, manufactured by Mitsui Toatsu Chemicals Inc., solubility to ethanol/ethyl acetate mixture (9/1) was 19 g/l) | |
| sublimable dye | 7.5 |
| (Y-2, manufactured by Nippon Kayaku Co., Ltd., solubility to ethanol/ethyl acetate mixture (9/1) was 1 g/l) | |
| sublimable dye | 7.5 |
| (R-3, manufactured by Nippon Kayaku Co., Ltd., solubility to ethanol/ethyl acetate mixture (9/1) was 17 g/l) | |
| ethanol | 170 |
| n-butanol | 20 |
| (Formulation of dye-transferring layer coating liquid) | |
| polyvinyl butyral resin | 10 |
| (BX-1, manufactured by Sekisui Chemical Co., Ltd.) | |
| isocyanate compound | 3 |
| (Colonate L, manufactured by Nippon Polyurethane Industry Co., Ltd.) | |
| sublimable dye | 7.5 |
| (Y-2) | |
| ethanol | 171 |
| ethyl-acetate | 19 |
| (Formulation of coating liquid for resin layer having relatively low dye receivability) | |
| styrene-maleic acid Polymer | 5 |
| (Suprapal AP30, manufactured by BASF Ltd.) | |
| liquid α | 6 |
| ethanol | 18 |
| ethyl acetate | 2 |

Example 12

A dye-supplying layer coating liquid was coated with a wire bar on the intermediate adhesive layer which was prepared in Example 9 and dried so that the thickness was 4.0 μm on a dry basis, further thereon a dye-transferring layer coating liquid was coated and dried in a thickness of 1.0 μm on a dry basis, and still further thereon a coating liquid for a resin layer having a relatively low dye receivability was coated and dried in a thickness of 0.7 μm on a dry basis. The recording material was then aged for 12 hours at 60° C. to cure the coated layers.

Thus, a black colored recording material of the present invention was obtained.

| | |
|---|---|
| (Formulation of dye-supplying layer coating liquid) | |
| polyvinyl butyral resin | 7 |
| (BX-1, manufactured by Sekisui Chemical Co., Ltd.) | |
| polyethylene oxide | 3 |
| (Alcocks R400, manufactured by Meisei Chemical Works Ltd.) | |
| isocyanate compound | 3 |
| (Colonate L, manufactured by Nippon Polyurethane Industry Co., Ltd.) | |
| sublimable dye | 15 |
| (HS0144, manufactured by Mitsui Toatsu Chemicals Inc., solubility to ethanol/ethyl acetate mixture (9/1) was 19 g/l) | |
| sublimable dye | 7.5 |
| (Y-2, manufactured by Nippon Kayaku Co., Ltd., solubility to ethanol/ethyl acetate mixture (9/1) was 1 g/l) | |
| sublimable dye | 1.5 |
| (R-3, manufactured by Nippon Kayaku Co., Ltd., solubility to ethanol/ethyl acetate mixture (9/1) was | |

-continued

| | |
|---|---|
| 17 g/l) | |
| ethanol | 170 |
| n-butanol | 20 |
| (Formulation of dye-transferring layer coating liquid) | |
| polyvinyl butyral resin (BX-1, manufactured by Sekisui Chemical Co., Ltd.) | 10 |
| isocyanate compound (Colonate L, manufactured by Nippon Polyurethane Industry Co., Ltd.) | 3 |
| sublimable dye (Macrolex Yellow 6G, manufactured by Bayer Ltd., solubility to ethanol/ethyl acetate mixture (9/1) was greater than 40 g/l) | 7.5 |
| ethanol | 171 |
| ethyl acetate | 19 |
| (Formulation of coating liquid for a resin layer having relatively low dye receivability) | |
| styrene-maleic acid copolymer (Suprapal AP30; manufactured by BASF Ltd.) | 5 |
| liquid α | 6 |
| ethanol | 18 |
| ethyl acetate | 2 |

Comparative Example 5

A dye-supplying layer coating liquid was coated with a wire bar on the intermediate adhesive layer which was prepared in Example 9 and dried so that the thickness was 4.0 μm on a dry basis, and further thereon a dye-transferring layer coating liquid was coated and dried in a thickness of 1.0 μm on a dry basis. The recording material was then aged for 12 hours at 60° C. to cure the coated layers.

Thus, a comparative magenta colored recording material was obtained.

| | |
|---|---|
| (Formulation of dye-supplying layer coating liquid) | |
| polyvinyl butyral resin (BX-1, manufactured by Sekisui Chemical Co., Ltd.) | 7 |
| polyethylene oxide (Alcocks R400, manufactured by Meisei Chemical Works Ltd.) | 3 |
| isocyanate compound (Colonate L, manufactured by Nippon Polyurethane Industry Co., Ltd.) | 3 |
| sublimable dye (HM1O41, manufactured by Mitsui Toatsu Chemicals Inc., solubility to toluene was 97 g/l) | 7.5 |
| sublimable dye (Macrolex Red Violet R, manufactured by Bayer Ltd., solubility to toluene was 26 g/l) | 18 |
| ethanol | 170 |
| n-butanol | 20 |
| (Formulation of dye-transferring layer coating liquid) | |
| polyvinyl butyral resin (BL-S, manufactured by Sekisui Chemical Co., Ltd.) | 10 |
| isocyanate compound (Colonate L, manufactured by Nippon Polyurethane Industry Co., Ltd.) | 3 |
| toluene | 190 |

Comparative Example 6

A dye-supplying layer coating liquid was coated with a wire bar on the intermediate adhesive layer which was prepared in Example 9 and dried so that the thickness was 4.0 μm on a dry basis, further thereon a dye-transferring layer coating liquid was coated and dried in a thickness of 1.0 μm on a dry basis, and still further thereon a coating liquid for a resin layer having a relatively low dye receivability was coated and dried in a thickness of 0.7 μm on a dry basis. The recording material was then aged for 12 hours at 60° C. to cure the coated layers.

Thus, a comparative black colored recording material was obtained.

| | |
|---|---|
| (Formulation of dye-supplying layer coating liquid) | |
| polyvinyl butyral resin (BX-1, manufactured by Sekisui Chemical Co., Ltd.) | 7 |
| polyethylene oxide (Alcocks R400, manufactured by Meisei Chemical Works Ltd.) | 3 |
| isocyanate compound (Colonate L, manufactured by Nippon Polyurethane Industry Co., Ltd.) | 3 |
| sublimable dye (HSO144, manufactured by Mitsui Toatsu Chemicals Inc., solubility to ethanol/ethyl acetate mixture (9/1) was 19 g/l) | 15 |
| sublimable dye (Y-2, manufactured by Nippon Kayaku Co., Ltd., solubility to ethanol/ethyl acetate mixture (9/1) was 1 g/l) | 7.5 |
| sublimable dye (R-3, manufactured by Nippon Kayaku Co., Ltd., solubility to ethanol/ethyl acetate mixture (9/1) was 17 g/l) | 7.5 |
| ethanol | 170 |
| n-butanol | 20 |
| (Formulation of dye-transferring layer coating liquid) | |
| polyvinyl butyral resin (BX-1, manufactured by Sekisui Chemical Co., Ltd.) | 10 |
| isocyanate compound (Colonate L, manufactured by Nippon Polyurethane Industry Co., Ltd.) | 3 |
| ethanol | 171 |
| ethyl acetate | 19 |
| (Formulation of coating liquid for resin layer having relatively low dye receivability) | |
| styrene-maleic acid copolymer (Suprapal AP30, manufactured by BASF Ltd.) | 5 |
| liquid α | 6 |
| ethanol | 18 |
| ethyl acetate | 2 |

(Formation of Receiving Material (2) for Multiple Recording)

The following compounds were mixed to prepare a receiving layer coating liquid (2). The receiving layer coating liquid (2) was coated with a wire bar on synthetic paper 150 μm thick (Yupo FPG-150, manufactured by Oji Yuka Synthetic Paper Co., Ltd.), dried for 1 minute at 75° C. and then aged for 3 hours at 80° C. to form a cured receiving layer having a thickness of 5 μm.

Thus, a receiving material (2) for multiple sublimation thermal transfer recording was obtained.

| | |
|---|---|
| (Formulation of receiving layer coating liquid (2)) | |
| vinyl chloride-vinyl acetate-vinyl alcohol copolymer (VAGH, manufactured by Union Carbide Corp.) | 10 |
| isocyanate compound (Colonate L, manufactured by Nippon Polyurethane Industry Co., Ltd.) | 5 |
| amino modified silicone (SF8417, manufactured by Dow Corning Toray Silicone Co., Ltd.) | 0.5 |

-continued

| | |
|---|---|
| epoxy modified silicone (SF8411, manufactured by DOW Corning Toray Silicone Co., Ltd.) | 0.5 |
| toluene | 40 |
| methyl ethyl ketone | 40 |

(Recording Method)

Each recording material obtained in Examples 9–12 and Comparative Examples 5–6 was superimposed on the receiving material (2) so that the surface of the ink layer side of the recording material contacted the receiving layer of the receiving material (2) and heated from the back side thereof with a thermal printhead having a dot density of 12 dots/mm to which an electric power of 0.16 W/dot was applied. The following two kinds of multiple recording were performed.

(1) n-time Multiple Recording

A set of half tone images which had 11 steps of half tone images in gradation from a light image to a dark image was recorded on the receiving material (2) while each of the recording materials obtained in Example 9 and Comparative Example 5 and the receiving material (2) were fed at a speed of 8.4 mm/sec, respectively. This recording operation was repeated seven times using the same portion of each recording material (7-time multiple recording).

(2) n-fold Multiple Recording

A set of half tone images which had 11 steps of half tone images in gradation from a light image to a dark image was recorded on the receiving material (2) while each of the recording materials obtained in Examples 10–12 and Comparative Example 6 was fed at a speed of 1.2 mm/sec and the receiving material (2) was fed at a speed of 8.4 mm/sec (7-fold speed mode multiple recording). This recording operation was repeated seven times.

Difference of hue of each of the recorded images was visually observed.

The results are shown in Table 4.

TABLE 4

| | Difference of hue | Remarks |
|---|---|---|
| Example 9 | Difference of hue could not be observed in all of the recorded images of n being 1 to 7. | |
| Example 10 | Difference of hue could not be observed in the recorded images. | An image density of a top portion of the recorded image was slightly low. |
| Example 11 | Difference of hue could not be observed in the recorded images. | The recorded images had several small white spots. (*1) |
| Example 12 | Difference of hue could not be observed in the recorded images. | |
| Comparative Example 5 | The recorded half tone images when n was 1 to 3 were reddish colored and the half tone images having a relatively low image density were reddish colored. | |
| Comparative Example 6 | The top portion of the recorded image and the half tone images having a relatively low image density were reddish and violet-like colored. | |

(*1) The recorded image had white spots because of unevenness of the dye-supplying layer due to large particles of the yellow dye which were not dissolved in the coating liquid.

The results in Table 4 clearly indicate that the recording material of the present invention can produce images having good image qualities without difference of hue even when the image as recorded by the n-time mode multiple sublimation thermal transfer recording method or the n-fold speed mode multiple sublimation thermal transfer recording method.

In addition, when an image including characters was recorded using the recording materials of Example 12 and Comparative Example 6, the image recorded using the recording material of Example 12 included good black characters; however, the image recorded using the recording material of Comparative Example 6 included black characters whose horizontal lines were reddish and violet-like colored.

Additional modifications and variations of the present invention-are possible in light of the above teachings. It is therefore to be understood that within the scope of the appended claims the invention may be practiced other than as specifically described herein.

This application is based on Japanese patent Publication No. 09-044793, filed on Feb. 13, 1997, the entire contents of which are herein incorporated by reference.

What is claimed is:

1. A method for manufacturing sublimation thermal transfer recording material comprising the steps of:

preparing an ink layer coating liquid (1) comprising a solvent, a resin and a plurality of sublimable dye groups which have a different hue and each of which comprises one or more sublimable dyes, and a layer coating liquid (2) comprising a solvent and a resin and optionally comprising a sublimable dye;

coating the ink layer coating liquid (1) overlying a substrate and dried to form an ink layer (1); and coating the layer coating liquid (2) overlying the ink layer (1) and dried to form an overlaid layer.

2. The method for manufacturing sublimation thermal transfer recording material of claim 1, wherein solubility of each sublimable dye included in the ink layer (1) to the solvent included in the layer coating liquid (2) is substantially the same.

3. The method for manufacturing sublimation thermal transfer recording material of claim 1, wherein solubility of each sublimable dye included in the ink layer (1) to the solvent of the layer coating liquid (2) is less than about 20 g/l.

4. The method for manufacturing sublimation thermal transfer recording material of claim 1, wherein the solvent of the layer coating liquid (2) comprises an alcohol.

5. The method for manufacturing sublimation thermal transfer recording material of claim 1, the ink layer coating liquid (2) including at least a sublimable dye, and wherein a sublimable dye in the ink layer coating liquid (2) which has relatively low solubility to the solvent included in the ink layer coating liquid (2) compared to the other sublimable dyes included in the ink layer (1) is included in the ink layer coating liquid (2) in an amount greater than each amount of the other sublimable dyes in the ink layer coating liquid (2).

6. The method for manufacturing sublimation thermal transfer recording material of claim 1, the ink layer coating liquid (2) including at least a sublimable dye, and wherein the sublimable dye included in the ink layer coating liquid (2) has relatively high solubility to the solvent included in the ink layer coating liquid (2) compared to the other sublimable dyes included in the ink layer (1) and the hue of the sublimable dye is substantially the same as a sublimable dye which has relatively low solubility to the solvent included in the ink layer coating liquid (2) compared to the other sublimable dyes included in the ink layer (1).

* * * * *